United States Patent [19]

Czala

[11] 4,397,206

[45] Aug. 9, 1983

[54] FOOD SLICER

[75] Inventor: Ferenc L. Czala, Newbury, England

[73] Assignee: Lan-Elec Limited, Berkshire, England

[21] Appl. No.: 270,402

[22] Filed: Jun. 4, 1981

[30] Foreign Application Priority Data

Nov. 3, 1980 [GB] United Kingdom ..... 8035293

[51] Int. Cl.[3] ..... B26D 7/22

[52] U.S. Cl. ..... 83/399; 83/729; 83/730

[58] Field of Search ..... 83/399, 729, 730, 5.44, 83/DIG. 1, 397, 396, 397.1, 701, 478

[56] References Cited

U.S. PATENT DOCUMENTS 3,159,196 12/1964 Engi ..... 83/399
4,246,818 1/1981 McGraw ..... 83/399

FOREIGN PATENT DOCUMENTS 1196985 7/1965 Fed. Rep. of Germany ... 83/DIG. 1
2749652 10/1979 Fed. Rep. of Germany ... 83/DIG. 1

*Primary Examiner*—Donald R. Schran
*Attorney, Agent, or Firm*—Fidelman, Wolffe & Waldron

[57] ABSTRACT

A food slicer having a rotatable circular knife and a hopper releasably mounted on a carriage which is movable from an initial position towards and across the knife to cut food on the hopper into slices. A gauge plate is provided to adjust the thickness of cut as the hopper moves the food past the knife and a safety device is incorporated to prevent the hopper being removed from the carriage unless it is at its initial position. The safety device comprises a latch on the carriage holding the hopper thereon and a release mechanism engagable with the latch as the hopper is moved to its initial position to release it from the carriage.

9 Claims, 9 Drawing Figures

FIG.8.
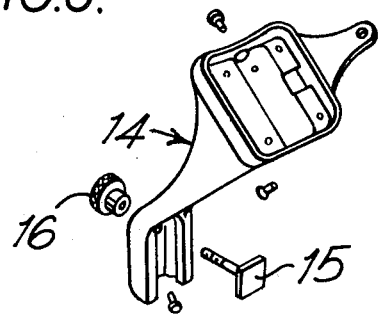
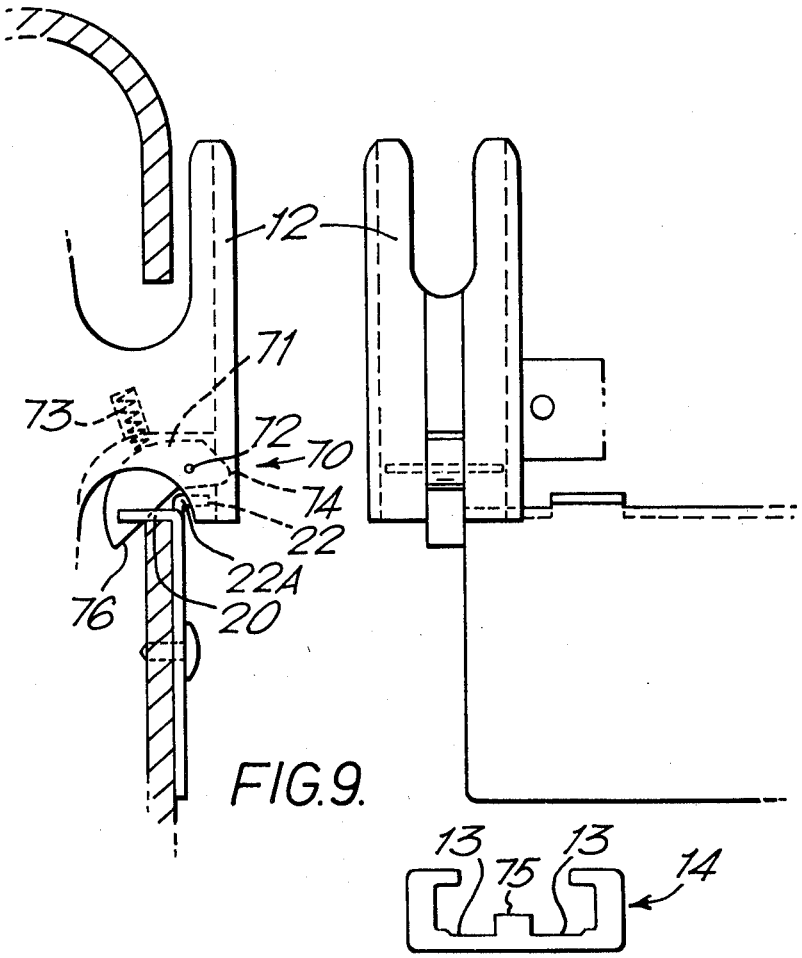
FIG.9.

FOOD SLICER

This invention relates to a food slicer having a safety device to prevent an operators hand coming into contact with the knife.

Manual and automatic food slicers usually comprise a food hopper which reciprocates forwards and backwards past a circular rotating knife which cuts food, such as bread or meat into slices whose thickness is determined by the spacing between a gauge plate and the knife. The gauge plate is mounted in a plane parallel to the plane of the circular knife and is movable between a position in line with the knife and a position corresponding to the maximum slice thickness. One end of the gauge plate is contoured complementary to that of the circular knife and is mounted closely adjacent thereto so that when the gauge plate is in line with the knife the spacing betweem them is such as to prevent the fingers of an operator touching the sharp circumferential edge of the knife.

The hopper is normally mounted so that it can be detached from the carriage for cleaning but if the gauge plate is not in line with the knife, as would normally be the case after slicing food, there is a danger that on removing the hopper an operator might cut himself on the unprotected edge of the blade.

It is an object therefore of this invention to provide a food slicer having a safety device which prevents removal of the hopper unless the gauge plate is in line with the knife.

Accordingly we provide a food slicer having a rotatable circular knife, a hopper releasably mounted on a carriage and movable from an initial position towards and across the knife to cut food on the hopper into slices, a gauge plate movably mounted parallel to the knife to adjust the thickness of cut as the hopper moves the food past the blade and a safety device comprising a latch which engages the hopper to retain it on said carriage and a release mechanism engagable with said latch when the hopper is in its specified position to release the latch only when the gauge plate is in line with said knife.

In the accompanying drawings:

FIG. 8 shows means for clamping the lower part of the hopper to the prongs of the carriage assembly; and FIG. 9 shows an additional latch to prevent the carriage being moved back along the shafts.

Figure 1:
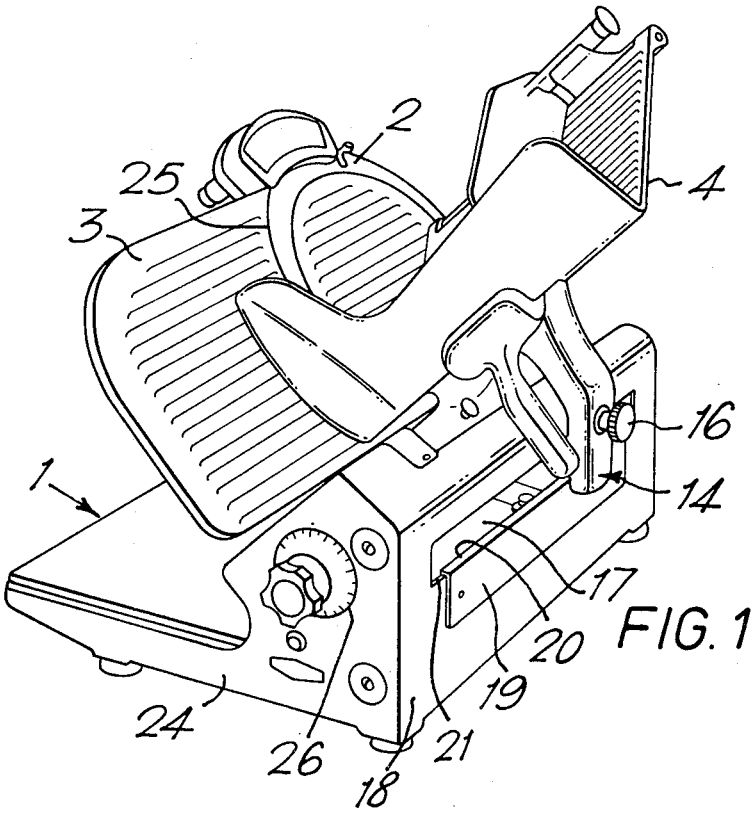
FIG. 1 is an isometric view of a food slicer in accordance with this invention.
Figure 2:
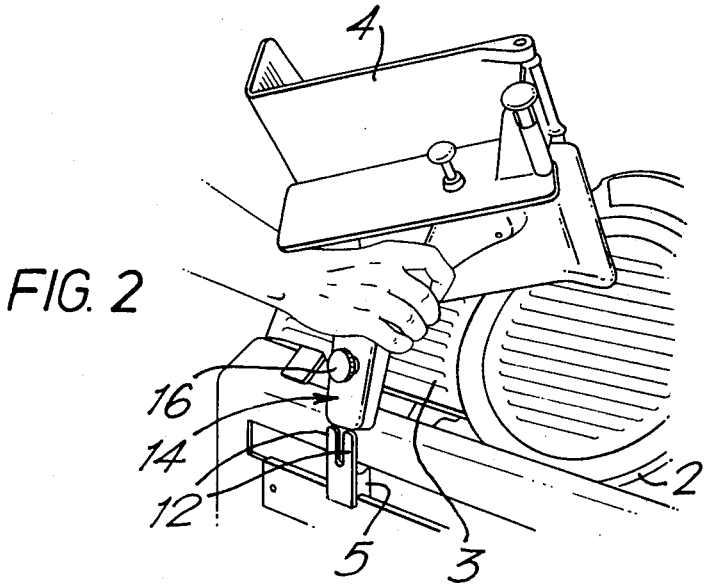
FIG. 2 is a rear view of the slicer shown in FIG. 1 illustrating removal of the hopper from the carriage.
Figure 6:
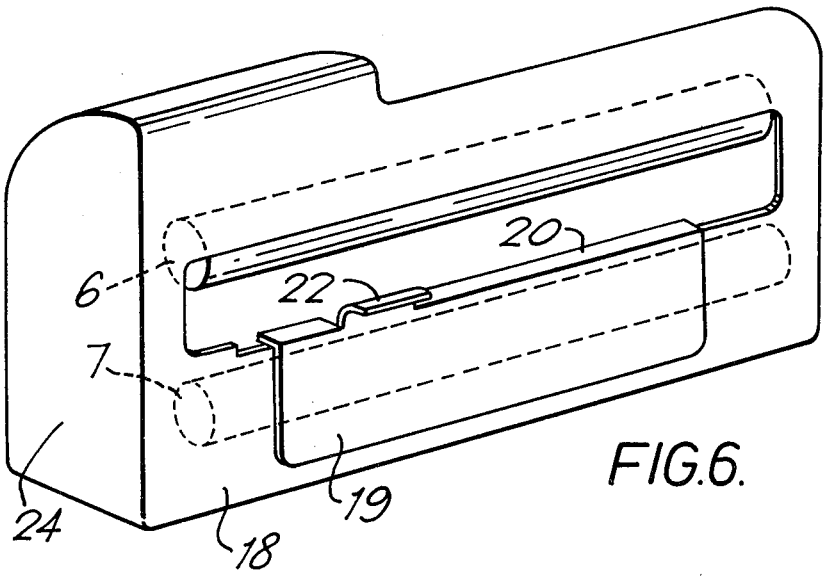
FIG. 6 is a view of the rear part of the slicer shown in FIG. 1 without the carriage, hopper, gauge plate and knife.

Referring now to FIGS. 1 and 2 there is shown a food slicer comprising a housing 1 mounting a motor driving via a gearbox a circular knife 2 mounted closely adjacent a gauge plate 3 movable in a plane parallel thereto. A food hopper 4 is removably mounted on a carriage assembly 5 slidable on shafts 6 and 7 (see FIG. 6) mounted one above the other and extending across the width of the housing 1.

Figure 3:
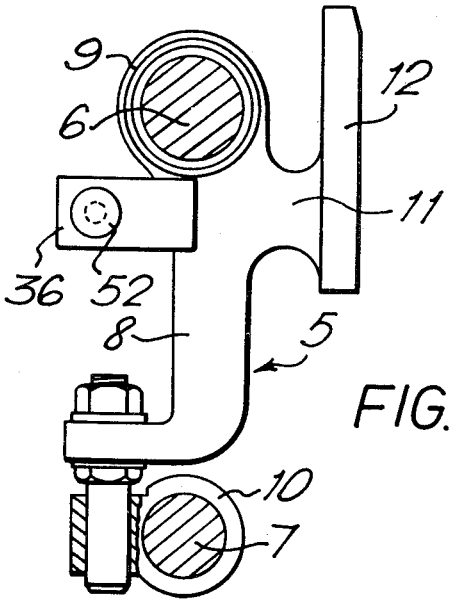
FIG. 3 shows the carriage assembly.

As shown in FIG. 3 the carriage assembly 5 includes a bracket 8 having at the top end thereof an elongate tube 9 which slides on shaft 6 and secured to the bottom end a bushing 10 which slides on shaft 7. Extending from bracket 8 on neck 11 are upstanding prongs 12 which engage channels 13 each side of the lower portion 14 of hopper 4 (see FIG. 4), the lower portion 14 being clamped to the prongs 12 by means of a plate 15 and screw 16 shown in FIG. 8. The neck 11 extends through a rectangular opening 17 in the rear wall 18 of the housing 1, a plate 19 having a flange portion 20 resting on the lower edge 21 of the opening 17 being secured to the rear wall 18. As shown in greater detail in FIG. 6, the flange portion 20 has a lip 22 bent away from the wall 18 to engage grooves 23 in the lower portion 14 of the hopper 4 (FIG. 4) as will be explained in more detail later on.

In operation, food, such as meat or bread is placed on the hopper 4 which is then moved from an initial position adjacent end wall 24 of the housing 1 past the knife 2 which cuts the food into slices, the thickness of which is determined by the position of the gauge plate 3 relative to the knife 2. One end 25 of the gauge plate 3 has a shape complimentary to that of the knife 3 and is mounted closely adjacent thereto so that when the gauge plate 3 is in line with the knife 2 corresponding to zero thickness of cut, it is impossible for the fingers of an operator to contact the peripheral cutting edge of the knife.

Figure 5:
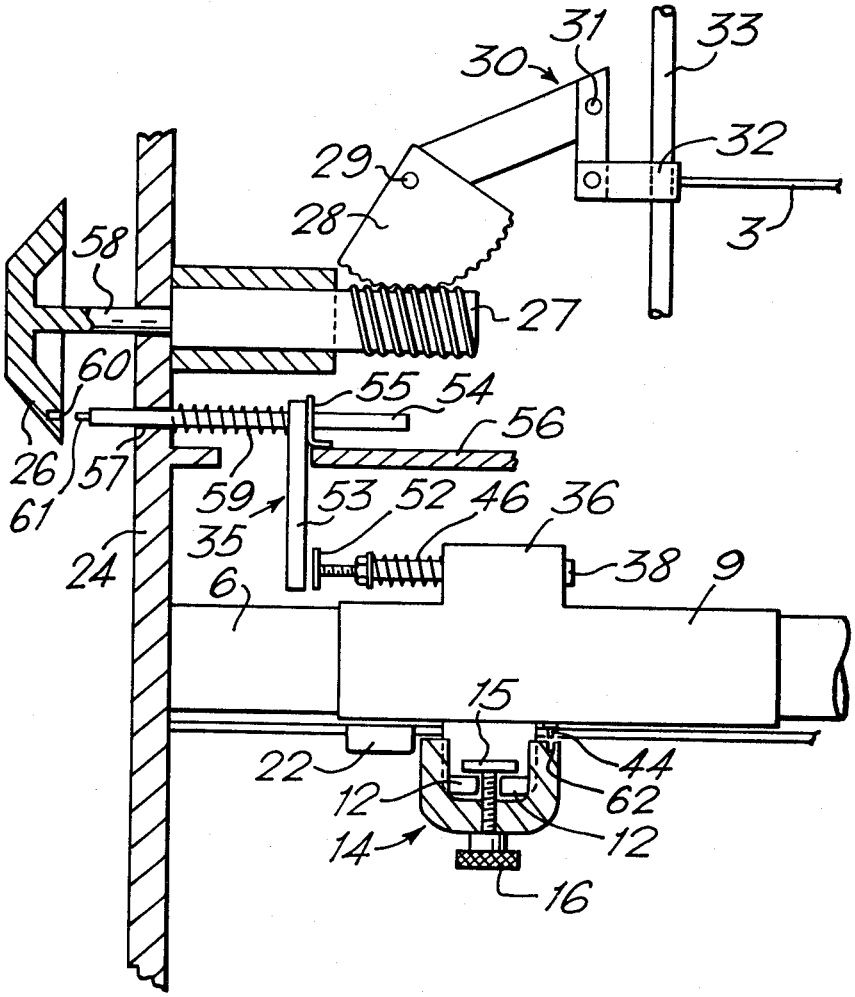
FIG. 5 is a sectional view through part of the slicer of FIG. 1 showing the latch release mechanism.

As shown in FIG. 5, the position of the gauge plate 3 is controlled by a knob 26 coupled to a worm gear 27 engaging a toothed quadrant 28 pivoted about a shaft 29 and coupled via a linkage 30 pivoted about a pin 31 to a bushing 32 sliding on a fixed shaft 33, the bushing 32 being coupled to the gauge plate 3 so that it is moved from a position in line with the knife to positions spaced therefrom corresponding to different thickness of cut as the knob 26 is rotated from its 'O' position.

To prevent an operator's hand coming into contact with the knife when removing the hopper 4 from the carriage assembly 5, a safety device in incorporated in the slicer to prevent removal of the hopper except when the knob 26 is in the 'O' position and the carriage and hopper are at the initial position adjacent the end wall 24 of the housing 1. The safety device basically comprises a latch 34 shown in FIG. 7 mounted on the carriage assembly 5 and a release mechanism 35 shown in FIG. 5 mounted in the housing adjacent the end wall 24.

The latch comprises a block 36 mounted on bracket 8 beneath tube 9 as shown in FIG. 3, the block having slidably mounted in a recess 37 a rod 38 with a waisted portion 39 for engaging the domed head 40 of a plunger 41 mounted in a further recess 42 at right angles to the recess 37. A compression spring 43 is mounted about the shaft 44 of plunger 41 between the domed head 40 and the end 45 of the recess 42. A further compression spring 46 is mounted about a shaft 47 integral with rod 38 and between the end of a recess 48 in one end of block 36 and a washer 49 locked by a nut 50 threaded on extension 51 to the end of shaft 47, the extension 51 having a disc 52 on the end thereof which engages a bar 53 of the release mechanism 35 when the carriage 5 is at the aforementioned initial position.

Referring now to FIG. 5, the release mechanism 35 comprises the bar 53 secured to a rod 54 mounted between a bracket 55 secured to an internal wall 56 of the housing 1 and an aperture 57 in the housing end wall 24 adjacent shaft 58 extending from worm gear 27. A compression spring 59 about rod 54 is located between the bracket 55 and end wall 24. The knob 26 secured to shaft 58 has an aperture 60 to receive a pin 61 extending from rod 54 when the knob 26 is in the 'O' position.

Figure 7:
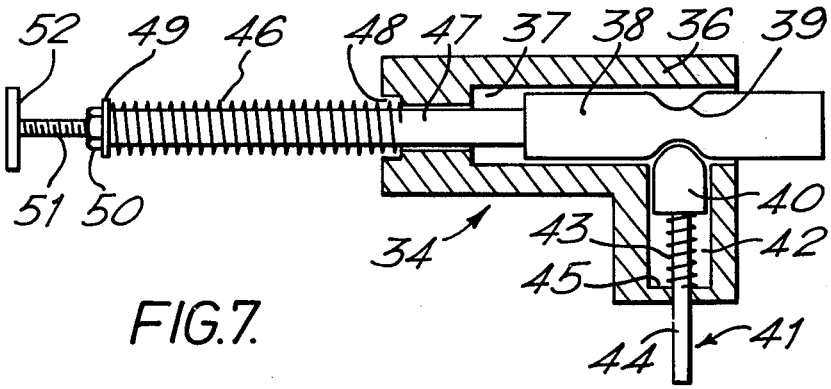
FIG. 7 is a cross sectional view of the latch forming part of the safety device.

In the normal position of the latch, the shaft 44 of plunger 41 is arranged to engage an elongate recess 62 in the lower portion 14 of hopper 4 to prevent removal of the hopper from the prongs 12 of the carriage assembly 5, i.e. the rod 38 is in its extreme leftwards position as viewed in FIG. 7 so that the right hand end thereof forces the domed head 40 and thus the shaft 44 outwards.

Assuming that the knob 26 is in a position other than the 'O' positon, when the hopper 4 and the carriage 8 is moved towards the end wall 24, the disc 52 engages the bar 53 compressing the spring 46 to move the waisted portion 39 of rod 38 into a position as shown in FIG. 7 to receive the domed head 40 of the plunger 41 under the action of the compression spring 43 since the bar 53 cannot move to the left as viewed in FIG. 5 as the pin 61 is not in registry with the aperture 60 in the knob 26.

Although the shaft 44 is thus withdrawn from the elongate recess 62 in the lower portion 14 of the hopper 4, it cannot be removed from the prongs 12 at this position of the carriage 5 since the lip 22 engages the grooves 23 in the lower portion 14. Further movement of the carriage 5 to disengage the grooves 23 from the lip 22 causes further movement of the rod 38 to the right as viewed in FIG. 7 which forces the domed portion 40 and the plunger 41 outwards moving the shaft 44 back into the recess 62.

Thus at any position of the hopper 4 and carriage 5 either the plunger 41 or the lip 22 prevents the hopper 4 from being removed from the prongs 12 when the knob 26 is in any position other than the 'O' position.

When the knob 26 is in the 'O' position movement of the carriage 5 to its initial position past the lip 22 results in the disc 52 engaging the bar 53 moving it together with the rod 54 against the force of compression spring 59 to the left as viewed in FIG. 5 causing pin 61 to enter the aperture 60 in knob 26 preventing the latter from being rotated thereby maintaining the gauge plate 3 in line with the knife 2. At the same time the disc 52 is moved back against the force of the compression spring 46 moving the waisted portion 39 of rod 38 into a position shown in FIG. 7 to receive the domed head 40 of plunger 41 thereby withdrawing shaft 44 from the elongate slot 62 in the lower portion 14 of the hopper 4 so that the latter can now be removed from the prongs 12 after loosening the screw 16 from the plate 15 (FIG. 8).

Preferably an additional latch 70 (FIG. 9) is provided to prevent the carriage assembly 5 from being moved back along the shafts 6 and 7 towards the knife 2 when the hopper 4 has been removed from the prongs 12. The latch 70 comprises a cam element 71 pivoted at 72 to the bracket 5 and urged anti-clockwise by a spring 73. The element 71 includes a nose portion 74 which engages the ridge 75 between channels 13 in the lower portion 14 of the hopper 4 as it is lowered on to the prongs 12 so as to lift the lower straight edge 76 of the element 71 above the flange portion 20 when the hopper 4 is clamped to the prongs 12. As the hopper 4 is removed from the prongs 12 when the carriage 5 is in the position shown in FIG. 2, i.e., when the shaft 44 is released from the recess 62, the spring 73 forces the element 71 to rotate anti-clockwise so that the straight edge 76 is forced down in front of edge 22A of lip 22. Thus the element 71 engaging the edge 22A prevents the carriage assembly 5 from being moved back along the shafts 6 and 7 after the hopper 4 has been removed from the prongs 12. A slit (not shown) immediately in front of the edge 22A may be formed in the lip 22 to receive the element 71 when the hopper 4 is removed from the prongs 12 to link the carriage 5 in position so that it cannot move either forwards or backwards along the shafts 6 and 7.

Figure 4:
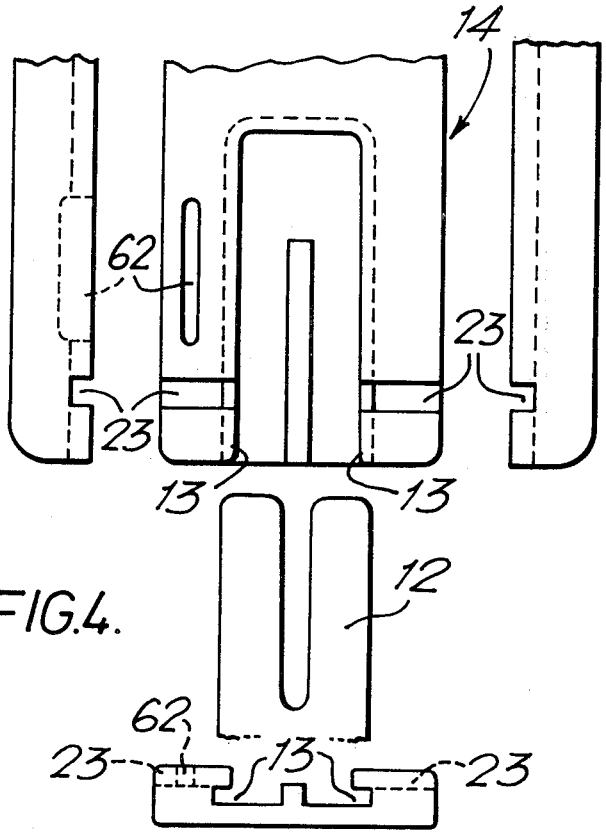
FIG. 4 shows the lower part of the hopper and the prongs of the carriage to which the hopper is clamped.

Since the above described action of withdrawing the plunger 41 from the elongate slot 62, FIG. 4 and the insertion of the pin 61 into the aperture 60, FIG. 5 of the knob 26 takes place at a position of the carriage 5 past the lip 22, the latter does not engage the grooves 23 in the lower portion 14 of the hopper 4 so as to prevent removal thereof from the prongs 12.

Whilst there has been shown and described a preferred form of safety device for a food slicer, it will be appreciated that other forms of safety device may be employed. For example a disc may be attached to the worm gear 27 with a recess to receive the disc 52 when the knob 26 is in its 'O' position thus locking the knob against rotation and forcing the rod 38 to the position shown in FIG. 7 to release the plunger 44 from the slot 62 in the lower portion 14 of the hopper 4.

Alternatively a spring loaded pin locking the hopper to the prongs of the carriage may be withdrawn by a ramp which is moved into position by the knob 26 when the latter is in its 'O' position, the ramp also actuating a link to lock the knob against rotation.

Whatever form the safety device takes, it is essential to provide a mechanism which retains the hopper on the carriage and releases it only when the gauge plate is in line with the knife. Preferably release of the latch is effected when the hopper is positioned away from the knife, for example when the hopper is in its initial or a predetermined position.

I claim:

1. A food slicer comprising a rotatable circular knife, a food hopper, a carriage, guide means guiding said carriage and thereby said hopper from an initial position towards and across said knife to cut food on the hopper into slices, a gauge plate mounted parallel to said knife to adjust the thickness of cut as the hopper moves the food past the knife and a safety device comprising, a first latch which engages the hopper to retain it on said carriage and a release mechanism engagable with said latch when the hopper is in said initial position to release the latch only when the gauge plate is in line with said circular knife.

2. A food slicer according to claim 1, including means for positioning said gauge plate relative to said knife; and wherein said release mechanism includes means locking said positioning means in an inoperative position when said hopper is in said initial position, said first latch including a movable member which engages said locking means and then moves to operate said release mechanism as said carriage is moved into said initial position.

3. A food slicer according to claim 2 wherein said hopper includes a recess and said release mechanism includes a spring loaded plunger engaged in said recess and wherein said movable member is mounted to retain said plunger in said recess, until said member engages said locking means when said hopper is moved to said initial position whereby said member moves to allow said spring loaded plunger to be retracted from the recess in said hopper to allow it to be removed from said carriage.

4. A food slicer according to claim 3 wherein said means for positioning said gauge plate includes a manually operable knob having a recess therein, and said means locking said positioning means includes a rod receivable in the recess in said knob as said movable member engages said locking means.

5. A food slicer according to claim 3 wherein said movable member includes a waisted portion and said spring loaded plunger includes a domed head received in said waisted portion when said hopper is at said initial position.

6. A food slicer according to claim 1, wherein said guide means comprises two rods mounted with their longitudinal axis in a plane parallel to a plane containing said rotatable circular knife and said carriage includes a block defining two bores through which pass said rods, said carriage mounting said first latch; said food slicer further including further means for retaining said hopper on said carriage until said hopper is at said initial position.

7. A food slicer according to claim 6 including a housing defining a longitudinal slot, said rods being mounted within said housing, and said carriage including a portion projecting through said slot and mounting said hopper; said housing having a flange adjacent said slot and said hopper having a slot to receive said flange to prevent the hopper being removed from said carriage portion until said hopper is at said initial position.

8. A food slicer according to claim 1 including a second latch mounted on said carriage and operable to prevent it from moving towards said knife after the hopper has been removed from the carriage.

9. A food slicer according to claim 7 including a second latch mounted on said carriage and including a spring loaded cam element engagable with said flange at the initial position of said hopper to prevent said carriage after the hopper is removed therefrom from moving towards said knife.

* * * * *